US009574528B2

(12) United States Patent
Hartzler et al.

(10) Patent No.: US 9,574,528 B2
(45) Date of Patent: Feb. 21, 2017

(54) EXHAUST GAS RECIRCULATION ADAPTER

(71) Applicant: Caterpillar Inc., Peoria, IL (US)

(72) Inventors: Aaron L. Hartzler, Lafayette, IN (US); Marian Avram, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 121 days.

(21) Appl. No.: 14/573,543

(22) Filed: Dec. 17, 2014

(65) Prior Publication Data

US 2016/0177880 A1 Jun. 23, 2016

(51) Int. Cl.
*F02M 25/07* (2006.01)
*F02M 35/10* (2006.01)

(52) U.S. Cl.
CPC ... *F02M 35/10222* (2013.01); *F02M 25/0722* (2013.01); *F02M 25/0727* (2013.01); *F02M 26/17* (2016.02); *F02M 26/19* (2016.02)

(58) Field of Classification Search
CPC ..... F02M 25/0722; F02M 25/0724; F02M 25/0727; F02M 26/13; F02M 35/10222; F02M 26/17; F02M 26/19
USPC ..... 123/568.17
See application file for complete search history.

(56) References Cited

U.S. PATENT DOCUMENTS 4,498,786 A * 2/1985 Ruscheweyh ..... B01F 5/0268 137/896
6,044,827 A * 4/2000 Pfaff ..... F02B 47/08 123/568.18
6,138,651 A * 10/2000 Mori ..... F02M 26/13 123/568.17
6,959,700 B2 * 11/2005 Wu ..... F02M 26/40 123/568.12
7,059,118 B2 * 6/2006 Ripper ..... B01F 5/0268 60/286
7,353,811 B2 * 4/2008 Weisz ..... F02D 9/18 123/568.17
7,552,722 B1 * 6/2009 Shieh ..... F02M 26/13 123/568.17
7,798,135 B2 * 9/2010 Bischofberger . F02M 35/10118 123/568.11
8,033,714 B2 * 10/2011 Nishioka ..... B01D 53/8631 137/888
8,056,340 B2 * 11/2011 Vaught ..... F02B 33/44 123/568.17
8,181,633 B2 * 5/2012 Ito ..... F02B 31/06 123/568.17
8,430,083 B2 4/2013 Kapala et al.
8,746,216 B2 * 6/2014 Elsasser ..... B01F 3/02 123/568.11
9,051,900 B2 * 6/2015 Teng ..... F02B 31/04
(Continued)

FOREIGN PATENT DOCUMENTS

JP 2000329010 11/2000
JP 2008069645 3/2008

*Primary Examiner* — Hai Huynh
(74) *Attorney, Agent, or Firm* — Pooja Mehta

(57) ABSTRACT

An exhaust gas recirculation adapter for an air intake system of an engine is disclosed. The exhaust gas recirculation adapter includes a tube portion defining an interior space therein. The exhaust gas recirculation adapter also includes a protrusion projecting into the interior space of the tube portion. The protrusion is configured to provide a surface for impacting of exhaust gases thereon.

12 Claims, 5 Drawing Sheets

(56) References Cited

U.S. PATENT DOCUMENTS

| | | | | |
|---|---|---|---|---|
| 2004/0079347 | A1* | 4/2004 | Bender | F02M 35/10118 123/568.17 |
| 2008/0295813 | A1* | 12/2008 | Yamanaka | F02M 35/10065 123/568.17 |
| 2010/0065028 | A1* | 3/2010 | Styles | F02D 9/1035 123/568.17 |

* cited by examiner

EXHAUST GAS RECIRCULATION ADAPTER

TECHNICAL FIELD

The present disclosure relates to an adapter, and more particularly to an exhaust gas recirculation adapter for an air intake system of an engine.

BACKGROUND

Engine systems generally include an Exhaust Gas Recirculation (EGR) loop associated therewith. The EGR loop is configured to reduce NOx generation and increase efficiency of the engine system by recirculating a part of the exhaust gases to an air intake system of an engine. The recirculated exhaust gases are generally introduced into an intake plenum of the air intake system and are mixed with the non-combusted intake air therewithin.

The recirculated exhaust gases generally have a very high velocity. In some situations, the high velocity exhaust gases tend to travel upstream from a junction point of the intake manifold and an exhaust line, in a direction opposite to that of an incoming air stream. The exhaust gases may continue to flow upstream towards other components of the engine system, for example, an aftercooler associated with the air intake system, or may enter boost lines of crankcase ventilation. Additionally, soot particles present in the exhaust gases may deposit on these engine components and affect an operational life of the engine components.

U.S. Pat. No. 8,430,083 describes a mixing apparatus adapted for mixing the flow of intake air and exhaust gas in a mixing chamber of a combustion engine including a housing having a bore formed therethrough extending between a first open end and a second open end. The housing includes a plurality of apertures formed in a side wall thereof adjacent the first open end. A retention member is formed in the side wall adjacent the second open end and is adapted to secure the mixing apparatus within the mixing chamber. The mixing apparatus includes a flow deflector disposed in the bore of the housing. The flow deflector includes a plurality of curved deflector surfaces formed therein which correspond in number to and are aligned with the plurality of apertures. An end cap is secured to the housing at the first open end thereof for closing the bore at the first open end.

SUMMARY OF THE DISCLOSURE

In one aspect of the present disclosure, an exhaust gas recirculation adapter for an air intake system of an engine is disclosed. The exhaust gas recirculation adapter includes a tube portion defining an interior space therein. The exhaust gas recirculation adapter also includes a protrusion projecting into the interior space of the tube portion. The protrusion is configured to provide a surface for impacting of exhaust gases thereon.

In another aspect of the present disclosure, an engine system is disclosed. The engine system includes an exhaust gas line. The engine system also includes a connector portion in fluid communication with the exhaust gas line. The engine system further includes a flow hood in fluid communication with the connector portion. The engine system includes an air intake system in fluid communication with the exhaust gas line. The air intake system includes an intake manifold in fluid communication with the flow hood. The air intake system also includes an exhaust gas recirculation adapter connected to the intake manifold upstream of the flow hood with respect to an intake air flow. The exhaust gas recirculation adapter includes a tube portion defining an interior space therein. The exhaust gas recirculation adapter also includes a protrusion projecting into the interior space of the tube portion. The protrusion is configured to provide a surface for impacting of exhaust gases entering the tube portion from the flow hood thereon. The protrusion is also configured to control a flow of the exhaust gases in a direction opposite to a direction of the intake air flow.

In yet another aspect of the present disclosure, a method for controlling a flow direction of exhaust gases in an air intake system is disclosed. The method includes providing a protrusion projecting into an interior space of a tube portion of an exhaust gas recirculation adapter. The method also includes introducing exhaust gases into the tube portion of the exhaust gas recirculation adapter. The method further includes impacting the exhaust gases on the protrusion of the exhaust gas recirculation adapter. The method includes obstructing a flow of the exhaust gases in a direction towards an aftercooler based on the impact. The method also includes introducing the exhaust gases into an intake manifold based on the obstruction.

Other features and aspects of this disclosure will be apparent from the following description and the accompanying drawings.

DETAILED DESCRIPTION

Figure 1:
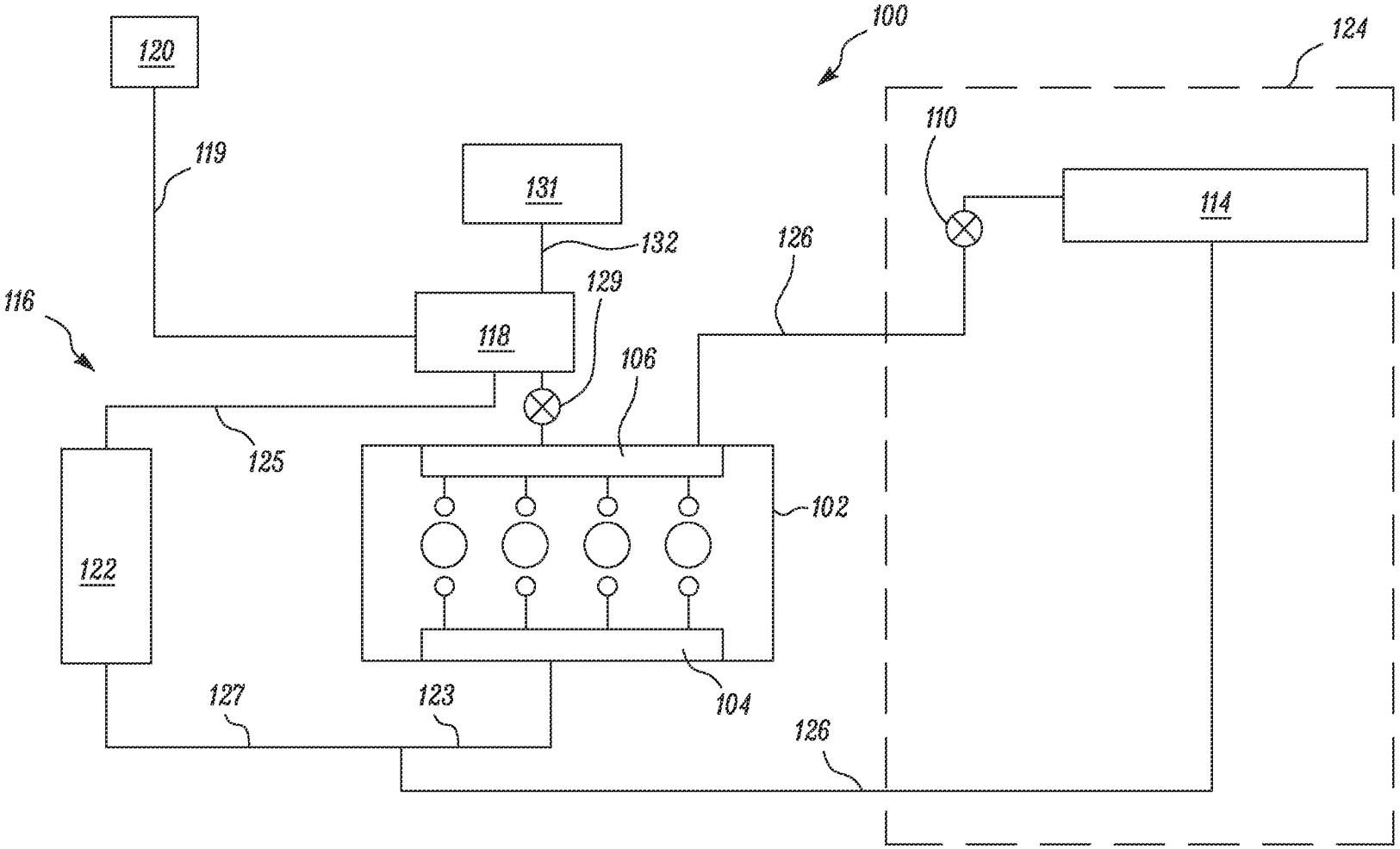
FIG. 1 is a schematic view of an exemplary engine system, according to one embodiment of the present disclosure.

Wherever possible, the same reference numbers will be used throughout the drawings to refer to the same or the like parts. FIG. 1 illustrates an exemplary engine system 100, according to one embodiment of the present disclosure. The engine system 100 may include an engine 102. In one embodiment, the engine 102 may include, for example, a diesel engine, a gasoline engine, a gaseous fuel powered engine such as, a natural gas engine, a combination of known sources of power, or any other type of power source apparent to one of skill in the art. As shown, the engine 102 may include an intake manifold 104 and an exhaust manifold 106. The intake manifold 104 is configured to receive intake air, which may include traces of recirculated exhaust gases therein, through an air intake system 116. Products of combustion may be exhausted from the engine 102 via the exhaust manifold 106.

Ambient air may be drawn into the engine 102 through an air filter 120 of the air intake system 116. The air intake system 116 of the engine system 100 may include a turbocharger 118. The intake air may be introduced into the turbocharger 118 via line 119, for compression purposes leading to a higher pressure thereof. The compressed intake air may then flow towards an aftercooler 122, via line 125. The aftercooler 122 is configured to decrease a temperature of the intake air flowing therethrough. In the illustrated embodiment, the aftercooler 122 is embodied as an air to air aftercooler. Alternatively, the aftercooler 122 may embody an air to liquid aftercooler. The intake air may then enter an intake air line 127 and further flow towards an intake plenum 123 of the air intake system 116, before being introduced into the intake manifold 104. The intake plenum 123 may be fluidly coupled to the intake manifold 104 and the intake air line 127.

The engine system 100 also includes an exhaust system 124. The exhaust system 124 is provided in fluid communication with the exhaust manifold 106. One of ordinary skill in the art will appreciate that when combustion temperatures may exceed approximately 1372° C., atmospheric nitrogen may react with oxygen, forming various oxides of nitrogen (NOx). In order to reduce the formation of NOx, the exhaust gas recirculation (EGR) process may be used to keep the combustion temperature below a NOx threshold. Therefore, a portion of the exhaust gas may be recirculated to the intake manifold 104 of the engine 102.

Accordingly, the exhaust system 124 may include an exhaust gas line 126. The exhaust gas line 126 is configured to receive the exhaust gases from the exhaust manifold 106. As shown in the accompanying figures, the exhaust system 124 may include an EGR valve 110. More particularly, the EGR valve 110 may be provided on the exhaust gas line 126, and may be configured to control the flow rate of the exhaust gases within the exhaust gas line 126. The EGR valve 110 may typically be vacuum or pressure operated, but may also be controlled by a controller (not shown) associated with the engine system 100.

The exhaust system 124 may also include an EGR cooler 114 provided on the exhaust gas line 126. The EGR cooler 114 may be configured to cool the high temperature exhaust gases leaving the engine 102, by heat exchange with a coolant. A person of ordinary skill in the art will appreciate that the EGR cooler 114 may include any air/coolant heat exchanger known to a person of ordinary skill in the art. The exhaust gases may further flow via the exhaust gas line 126 towards the intake manifold 104 for recirculation thereof. The exhaust gases may be mixed with the intake air flow from the intake air line 127 while flowing towards the intake manifold 104 via the intake plenum 123. The engine system 100 may also include an exhaust restriction valve 129. The exhaust restriction valve 129 is configured to connect the exhaust manifold 106 with an aftertreatment device 131 associated with the engine system 100, via line 132. The exhaust restriction valve 129 may be configured to force the exhaust gases through the EGR valve 110, thereby redirecting the exhaust gases away from the turbocharger 118. The present disclosure relates to controlling of the flow direction of the exhaust gases at a junction point of the exhaust gas line 126 with the intake air line 127 and the intake plenum 123, and will be explained in detail in connection with FIG. 2.

Figure 2:
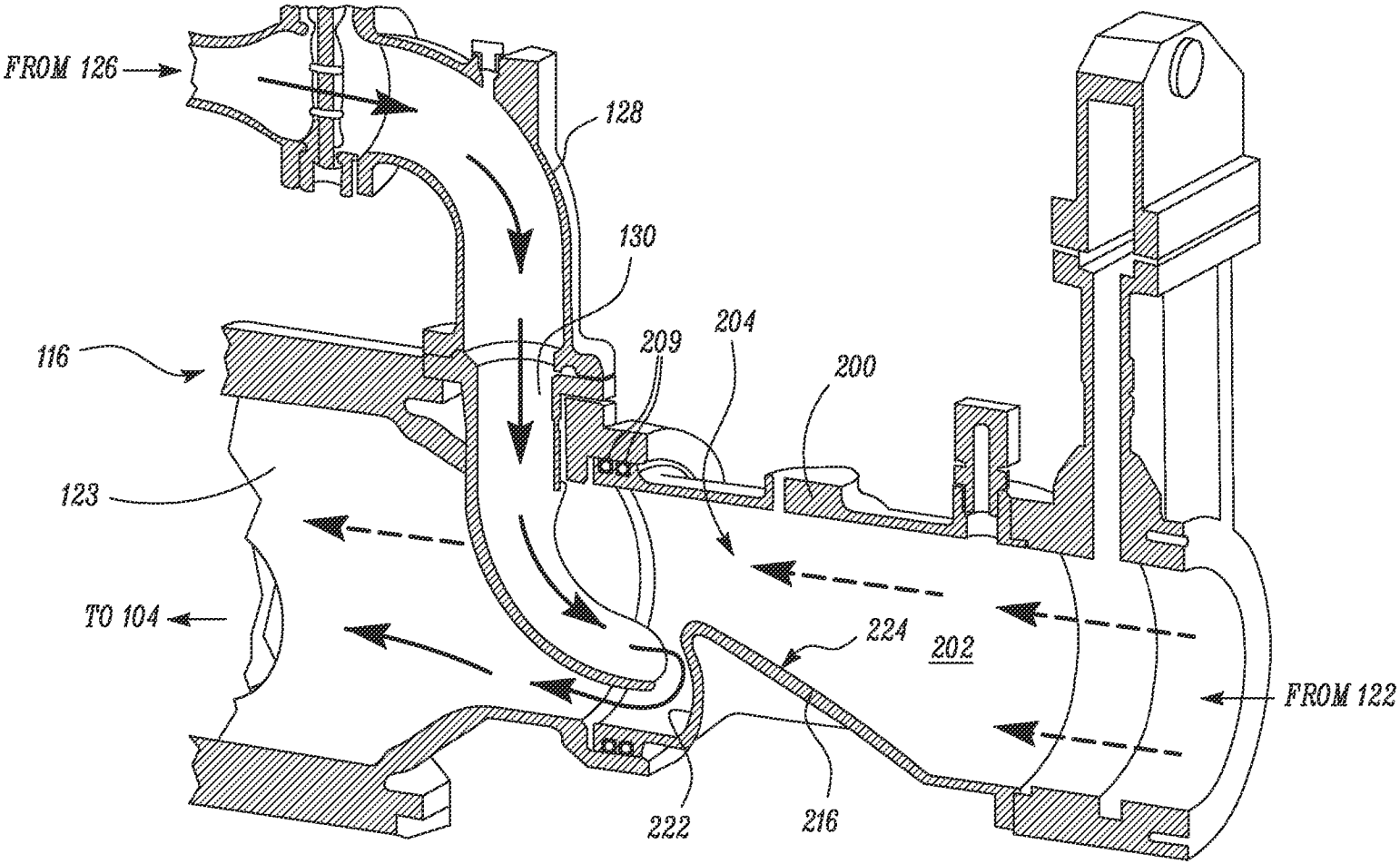
FIG. 2 is a perspective cross sectional view of a portion of the engine system having an exhaust gas recirculation (EGR) adapter associated therewith, according to one embodiment of the present disclosure.

Referring to FIG. 2, the exhaust gases from the exhaust gas line 126 may be introduced into a connector portion 128 of the exhaust system 124. The connector portion 128 may have bending shape. In one embodiment, the connector portion 128 may embody an elbow. The exhaust system 124 may further include a flow hood 130. An upstream side of the flow hood 130 is provided in fluid communication with the connector portion 128. Further, a downstream side of the flow hood 130 is provided in fluid communication with the intake plenum 123. The flow hood 130 may include a curved pipe design. In some embodiments, the flow hood 130 may be embodied as an EGR mixer which promotes a mixing of the EGR gases and increase its velocity.

The exhaust gases flowing through the exhaust system 124 may have a high velocity. Additionally, the high velocity exhaust gases may include soot and other foreign particles present therein. The soot particles, if contacted with components of the engine system 100 may damage these components. The present disclosure relates to an EGR adapter 200 associated with the air intake system 116 of the engine 102. The EGR adapter 200 is configured to fluidly couple the intake plenum 123 with the intake air line 127. Flow directions of the exhaust gases are depicted using bold arrows and that of the intake air is depicted using dashed arrows in FIG. 2. The EGR adapter 200 may be provided upstream of the flow hood 130 with respect to the intake air flow. A downstream side of the EGR adapter 200 may be provided in fluid communication with the intake manifold 104, via the intake plenum 123, with respect to the intake air flow. Further, an upstream side of the EGR adapter 200 may be provided in fluid communication with the intake air line 127, with respect to the intake air flow.

Figure 3:
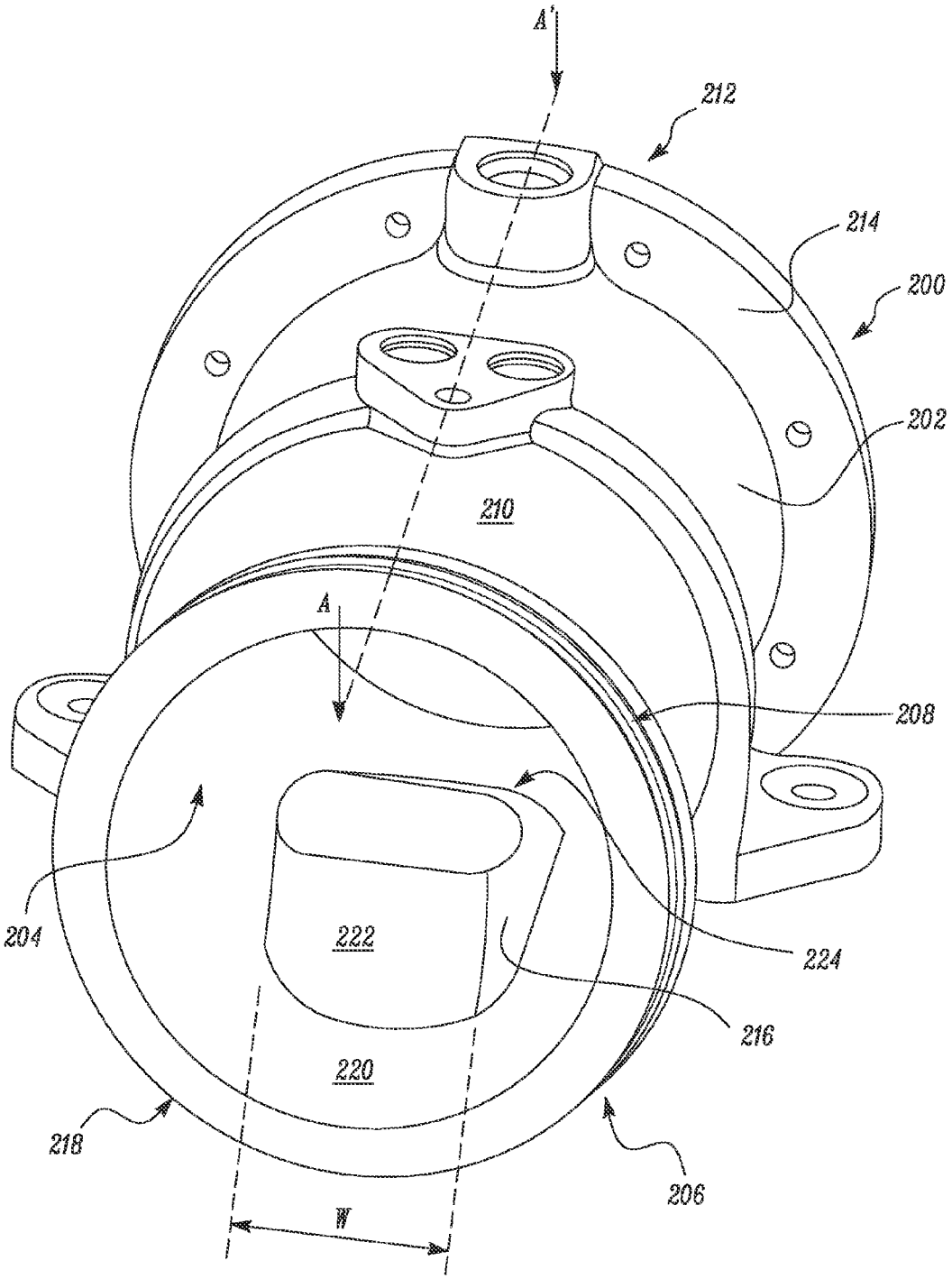
FIG. 3 is a perspective view of the EGR adapter having a plane A-A', according to one embodiment of the present disclosure.
Figure 4:
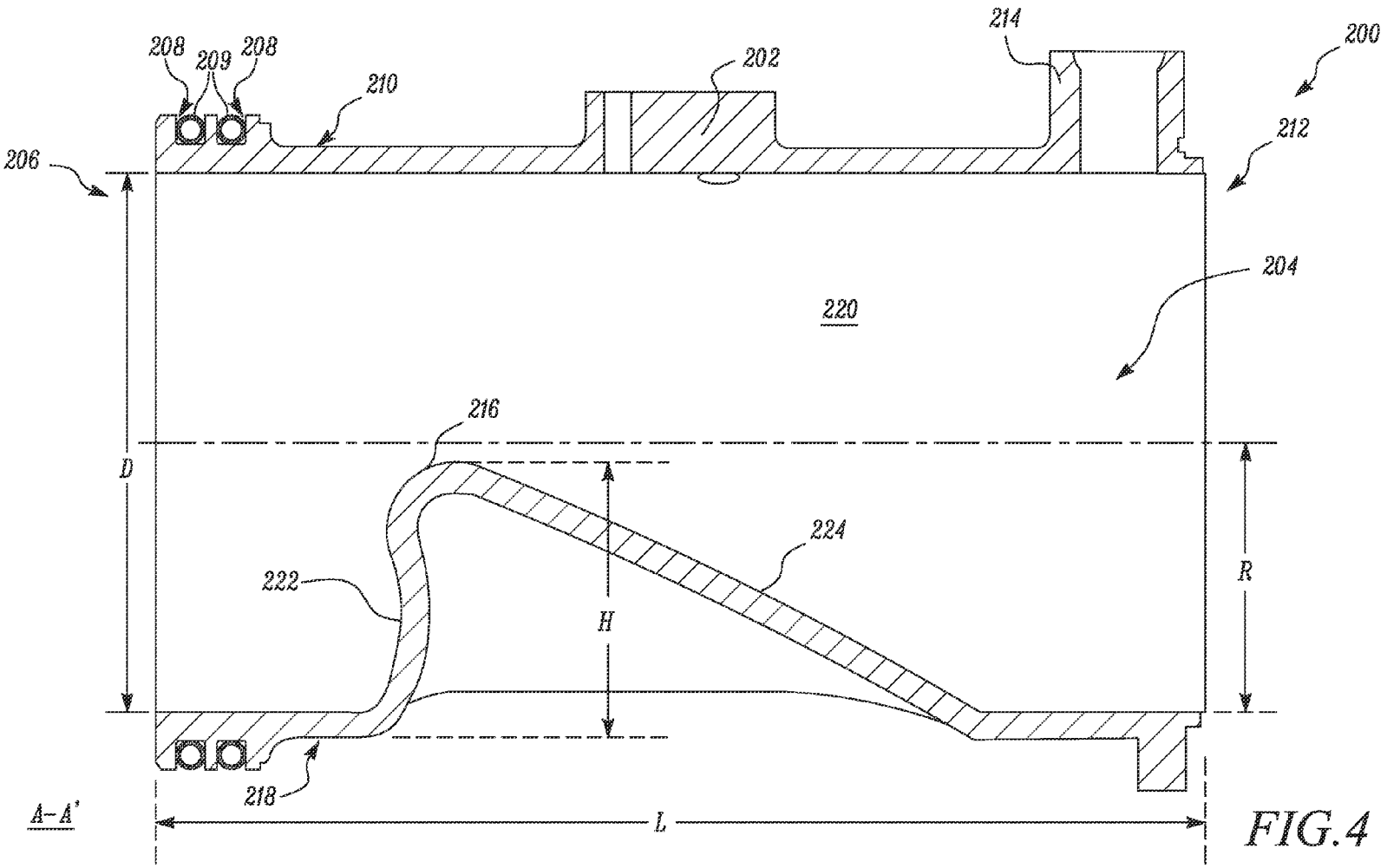
FIG. 4 is a cross sectional view of the EGR adapter of FIG. 3 along the plane A-A', according to one embodiment of the present disclosure.

Referring to FIGS. 2, 3, and 4, the EGR adapter 200 includes a tube portion 202. The tube portion 202 defines an interior space 204 therewithin. In the illustrated embodiment, the tube portion 202 has a straight cylindrical configuration. Alternatively, the tube portion 202 may include a stepped configuration (not shown). In one embodiment, the tube portion 202 may be coupled with the intake plenum 123 by a slip joint. In alternate embodiments, the connection between the tube portion 202 and the intake plenum 123 may include a flange (not shown), or any other joint known to a person of ordinary skill in the art. Further, a first end 206 (see FIGS. 3 and 4) of the tube portion 202 may include a sealing groove 208 (see FIG. 4) provided on an outer surface 210 thereof. The sealing groove 208 may receive a sealing ring 209 (see FIG. 2) therein. The sealing ring 209 may be configured to seal the joint between the EGR adapter 200 and the intake plenum 123 (see FIG. 2) of the air intake system 116. In one example, the sealing ring 209 may be embodied as an O-ring.

Further, a second end 212 of the tube portion 202 may include a flange 214. The flange 214 may be configured to attach the EGR adapter 200 with the aftercooler 122. Alternatively, the second end 212 may include threads (not shown) provided on the outer surface 210 of the tube portion 202 for threadable coupling of the EGR adapter 200 with the aftercooler 122. In alternate embodiments, the EGR adapter 200 and the aftercooler 122 may be connected using a flange (not shown). Further, the second end 212 of the EGR adapter 200 may include O-rings (not shown) for sealing the joint between the EGR adapter 200 and the aftercooler 122.

As shown in to FIGS. 2 to 4, the EGR adapter 200 includes a protrusion 216 provided therewithin. The protrusion 216 may have a ramped geometry. The protrusion 216 projects into the interior space 204 of the tube portion 202. The protrusion 216 is configured to provide a surface for impacting the exhaust gases thereon (see FIG. 2). The protrusion 216 is also configured to control a flow direction of the exhaust gases in a direction opposite to a flow direction of the intake air flow. Moreover, the protrusion 216 provides the surface for the exhaust gases of high velocity to impact, and may further obstruct the flow of the exhaust gasses towards the intake air line 127 and deflect the exhaust gases to enter the intake plenum 123. When the high velocity exhaust gases impact the protrusion 216, the speed of the exhaust gases may drop, allowing the exhaust gases to enter into the intake plenum 123 in the direction of the intake air flow.

The protrusion 216 is provided at a bottom section 218 of the tube portion 202. More particularly, the protrusion 216 is provided on an inner surface 220 of the bottom section 218 of the tube portion 202. In one embodiment, the protrusion 216 may be integral with and formed by a portion of the inner surface 220 of the tube portion 202. Alternatively, the protrusion 216 may be externally manufactured as a separate unit and attached to the inner surface 220 of the tube portion 202 by using suitable fastening means.

The protrusion 216 may include a first wall 222 and a second wall 224. The first wall 222 of the protrusion 216 is configured to face the exhaust gases coming from the flow hood 130 (see FIG. 2). The first wall 222 of the protrusion 216 is configured to obstruct the flow of the exhaust gases opposite to that of the intake air. The first wall 222 of the protrusion 216 provides the surface for deflection of the exhaust gases impacted thereon. The first wall 222 may include a concave shaped surface, so that the concave shaped surface of the first wall 222 may deflect or change the flow direction of the exhaust gases towards the intake plenum 123. As a result, the flow velocity of the exhaust gases is considerably reduced on impacting the first wall 222 of the protrusion 216. Alternatively, the first wall 222 may include any other shape that may deflect or change the flow direction of the exhaust gases towards the intake plenum 123.

Further, the second wall 224 of the protrusion 216 may be configured to face the intake air flow from the aftercooler 122. In one example, the second wall 224 may have an aerodynamic profile, such that the second wall 224 may direct the intake air flow towards the intake plenum 123 of the air intake system 116. Further, the intake air flow may mix with the exhaust gases in the intake plenum 123.

Dimensions of the EGR adapter 200 may be chosen as per the application. A height "H" (see FIG. 4) of the protrusion 216 is decided such that the protrusion 216 does not completely block or obstruct the intake air flow. Accordingly, the protrusion 216 has the height "H", such that the height "H" of the protrusion 216 is lesser than or equal to a radius "R" (see FIG. 4) of the tube portion 202. Alternatively, the height "H" of the protrusion 216 may be greater than the radius "R" of the tube portion 202. In some embodiments, the height "H" of the protrusion 216 may be up to the diameter "D" of the tube portion 202.

Further, a width "W" (see FIG. 3) of the protrusion 216 may be lesser than a diameter "D" (see FIG. 4) of the tube portion 202. It should be noted that based on the type of application, the height "H" and the width "W" of the protrusion 216 may vary from that shown in the accompanying figures. It should further be noted that the positioning of the protrusion 216 within the tube portion 202 may vary so that all of the exhaust gases entering the tube portion 202 contacts the protrusion 216 of the EGR adapter 200. The EGR adapter 200 may be made from a metal or a polymer known to a person of ordinary skill in the art.

INDUSTRIAL APPLICABILITY

The exhaust gases generally flow at a very high velocity, such that the exhaust gases travel upstream and opposite to that of the intake air flow. Further, exhaust gases may include soot particles therein. These soot particles, if contacted with the engine components, may get deposited thereon. In some situations, the engine components may get completely damaged and require replacement, which may increase an overall operational cost of the engine system.

The present disclosure relates to the EGR adapter 200. The EGR adapter 200 includes the protrusion 216. The protrusion 216 may act as a barrier for the soot particles present in the exhaust gases, causing soot particles within the impacted exhaust gases to deposit on the surface of the first wall 222 of the protrusion 216. More particularly, the protrusion 216 may control, obstruct, or reduce the soot particles travelling with the exhaust gases from contacting the engine components present downstream of the exhaust gases. For example, the protrusion 216 may inhibit the soot particles from traveling upstream into the intake air flow and enter the boost lines of the crankcase ventilation and also prevent the soot particles from hitting the aftercooler 122. Accordingly, the engine components may not require frequent maintenance, thereby decreasing the cost associated with the operation of the engine system 100. Further, the protrusion 216 and the design of the EGR adapter 200 may promote improved and uniform mixing of the recirculated exhaust gases with the intake air flow, which in turn may lead to an increase in the efficiency of the engine system 100.

Figure 5:
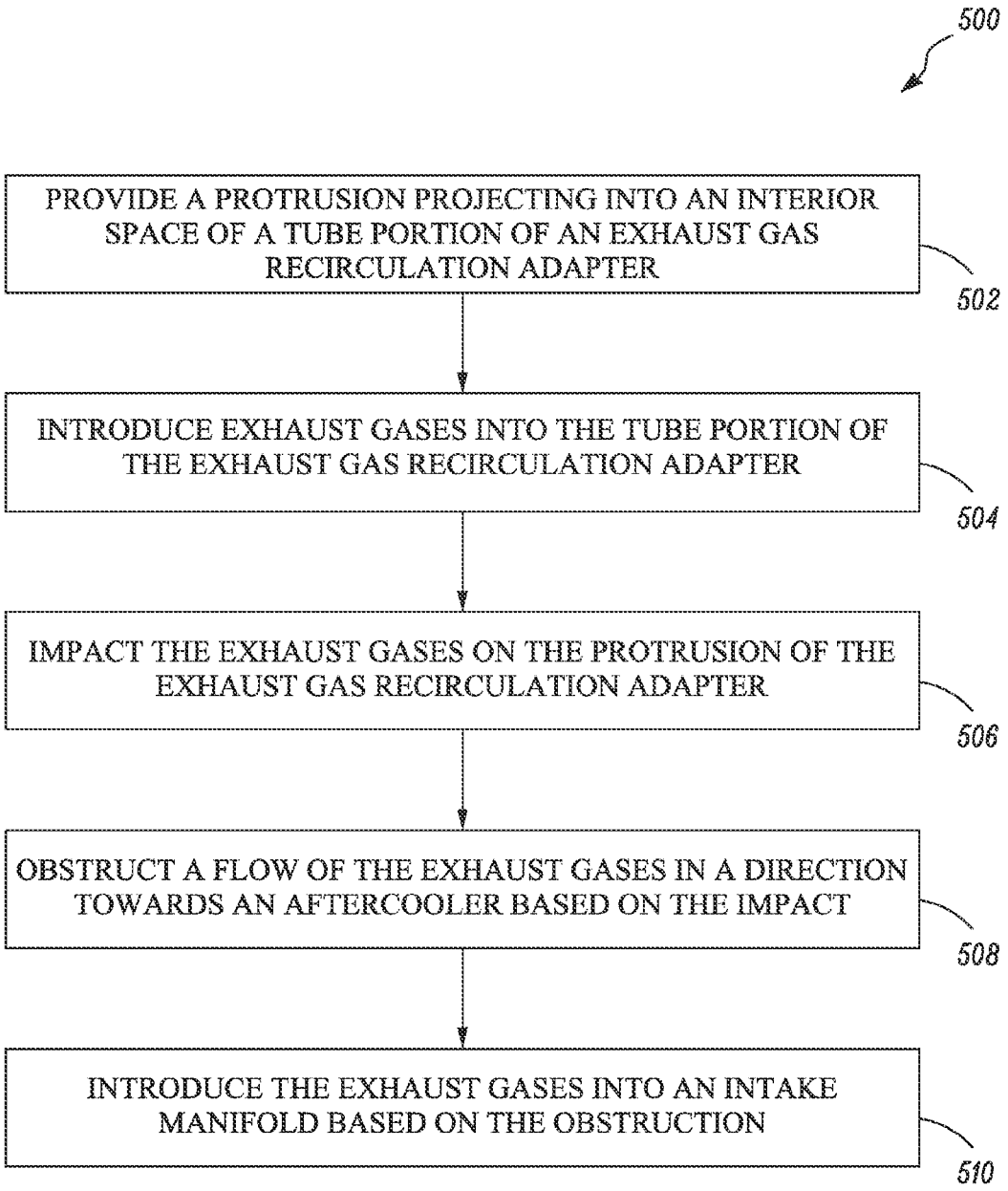
FIG. 5 is a flowchart of a method for controlling a flow direction of exhaust gases in an air intake system, according to one embodiment of the present disclosure.

FIG. 5 is a flowchart for a method 500 of controlling the flow direction of exhaust gases in the air intake system 116. At step 502, the protrusion 216 is provided such that it projects into the interior space 204 of the tube portion 202 of the EGR adapter 200. At step 504, the exhaust gases are introduced into the tube portion 202 of the EGR adapter 200.

At step 506, the exhaust gases are impacted on the protrusion 216 of the EGR adapter 200. Further, the flow direction of the exhaust gases may be changed based on the impact of the exhaust gases on the protrusion 216 of the EGR adapter 200. At step 508, based on the impact, the flow direction of the exhaust gases is obstructed in the direction towards the intake air line 127 or the aftercooler 122. At step 510, based on the obstruction, the exhaust gases are deflected and are introduced into the intake plenum 123 and further flows into the intake manifold 104 of the engine 102. Further, the intake air flow is mixed with the exhaust gases and introduced into the intake manifold 104, via the intake plenum 123.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An exhaust gas recirculation adapter for an air intake system of an engine, the exhaust gas recirculation adapter comprising:

a tube portion defining an interior space therein; and a protrusion provided on an inner surface of a bottom section of the tube portion and projecting into the interior space of the tube portion, the protrusion including a first wall facing exhaust gases and a second wall facing intake air, the first wall and the second wall defining a height and a width of the protrusion such that the height and the width are less than a diameter of the tube portion; and wherein the first wall includes a concave shaped surface configured to provide a surface for impacting of the exhaust gases flowing in a direction opposite to the intake air and deflecting the impacted exhaust gases in a direction of flow of the intake air.

2. The exhaust gas recirculation adapter of claim 1, wherein the protrusion has a ramped geometry.

3. The exhaust gas recirculation adapter of claim 1, wherein the protrusion is attached to an inner surface of the tube portion.

4. The exhaust gas recirculation adapter of claim 1, wherein the protrusion is integral with and formed by a portion of an inner surface of the tube portion.

5. The exhaust gas recirculation adapter of claim 1 further comprising sealing rings provided on an outer surface of the tube portion.

6. An engine system comprising:

an exhaust gas line;

a connector portion in fluid communication with the exhaust gas line;

a flow hood in fluid communication with the connector portion; and an air intake system in fluid communication with the exhaust gas line, the air intake system comprising:

an intake manifold in fluid communication with the flow hood; and an exhaust gas recirculation adapter connected to the intake manifold upstream of the flow hood with respect to intake air flow, the exhaust gas recirculation adapter comprising:

a tube portion defining an interior space therein; and a protrusion provided on an inner surface of a bottom section of the tube portion and projecting into the interior space of the tube portion, the protrusion including a first wall facing exhaust gases and a second wall facing intake air, the first wall and the second wall defining a height and a width of the protrusion such that the height and the width are less than a diameter of the tube portion;

wherein the first wall includes a concave shaped surface configured to:

provide a surface for impacting of the exhaust gases entering the tube portion from the flow hood thereon, wherein the exhaust gases flow in a direction opposite to the intake air; and deflect a flow of the exhaust gases in a direction of the intake air flow.

7. The engine system of claim 6, wherein the exhaust gas recirculation adapter is in fluid communication with an aftercooler.

8. The engine system of claim 6 further comprising sealing rings provided on an outer surface of the tube portion.

9. The engine system of claim 6, wherein the protrusion is positioned upstream of the flow hood with respect to the intake air flow.

10. The engine system of claim 6, wherein the protrusion has a ramped geometry.

11. A method for controlling a flow direction of exhaust gases in an air intake system, the method comprising:

providing a protrusion on an inner surface of a bottom section of the tube portion, the protrusion projecting into an interior space of a tube portion of an exhaust gas recirculation adapter, the protrusion includes a first wall and a second wall defining a height and width of the protrusion, wherein the height and the width are less than a diameter of the tube portion;

introducing exhaust gases in a direction opposite to intake air flow, into the tube portion of the exhaust gas recirculation adapter;

impacting the exhaust gases on the first wall of the protrusion of the exhaust gas recirculation adapter, wherein the first wall has a concave shaped surface;

changing a flow of the impacted exhaust gases in a direction of the intake air flow; and introducing the impacted exhaust gases into an intake manifold based on the deflection.

12. The method of claim 11 further comprising:

introducing the intake air flow into the intake manifold via the exhaust gas recirculation adapter.

* * * * *